US007106003B2

(12) United States Patent
Bschorer

(10) Patent No.: US 7,106,003 B2
(45) Date of Patent: Sep. 12, 2006

(54) DIELECTRIC BARRIER DISCHARGE LAMP WITH PINCH SEAL

(75) Inventor: Georg Bschorer, Herbrechtingen (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 164 days.

(21) Appl. No.: 10/799,592

(22) Filed: Mar. 15, 2004

(65) Prior Publication Data

US 2004/0183467 A1 Sep. 23, 2004

(30) Foreign Application Priority Data

Mar. 21, 2003 (DE) ..... 103 12 720

(51) Int. Cl.
*H01J 17/18* (2006.01)

(52) U.S. Cl. ..... 313/634; 313/567; 313/623

(58) Field of Classification Search ..... 313/634, 313/625, 607, 318.07, 567, 623
See application file for complete search history.

(56) References Cited

U.S. PATENT DOCUMENTS

| | | | | |
|---|---|---|---|---|
| 3,543,361 | A * | 12/1970 | Goto | 445/27 |
| 3,673,454 | A * | 6/1972 | Notelteirs | 313/332 |
| 4,366,409 | A * | 12/1982 | Nieda et al. | 313/569 |
| 4,550,269 | A * | 10/1985 | Dixon | 313/331 |
| 5,384,515 | A | 1/1995 | Head et al. | 313/607 |
| 5,604,410 | A | 2/1997 | Vollkommer et al. | |
| 6,097,155 | A | 8/2000 | Vollkommer et al. | |
| 6,411,037 | B1 * | 6/2002 | Ohkawai et al. | 313/623 |
| 6,605,899 | B1 | 8/2003 | Berlinghof et al. | |
| 2002/0163306 | A1 * | 11/2002 | Berlinghof et al. | 313/625 |
| 2003/0111960 | A1 * | 6/2003 | Doll et al. | 315/109 |

FOREIGN PATENT DOCUMENTS

JP 2001210277 8/2001

OTHER PUBLICATIONS

*Abstract*, JP2001210277 (Aug. 3, 2001).

* cited by examiner

*Primary Examiner*—Ashok Patel
*Assistant Examiner*—Christopher Raabe
(74) *Attorney, Agent, or Firm*—Robert F. Clark

(57) ABSTRACT

A dielectric barrier discharge lamp with a discharge vessel (1) has at least one inner electrode (5*a;* 5*b*) which is covered with a dielectric layer (6*a;* 6*b*) and is arranged on the inner side of the discharge vessel (1) The at least one inner electrode (5*a;* 5*b*) is electrically conductively connected to a supply conductor (8*a;* 8*b*) in a leadthrough region, the leadthrough region being realized by a gastight pinch (9).

7 Claims, 3 Drawing Sheets

DIELECTRIC BARRIER DISCHARGE LAMP WITH PINCH SEAL

TECHNICAL FIELD

The invention is based on a dielectric barrier discharge lamp having at least one inner electrode, in particular with a tubular discharge vessel.

With this type of lamps, although the electrodes are arranged inside the discharge vessel, at least the electrode of one polarity is separated from the interior of the discharge vessel by a dielectric, for example by a dielectric coating. In operation, this gives rise to what is known as a single-sided dielectric barrier discharge. Alternatively, it is also possible for all the electrodes to be provided with a dielectric barrier. This is then a two-sided dielectric barrier discharge.

Dielectric barrier discharge lamps with inner electrodes have the advantage that the thickness and the materials properties of the dielectric layer can be optimized in terms of the discharge properties and lamp efficiency. The dielectric layer is typically from approximately one hundred to a few hundred μm thick. In the case of outer electrodes, on the other hand, the thickness of the dielectric layer—i.e. in this case the wall thickness of the discharge vessel—is typically approx. 1 mm or above, depending on the size and shape of the discharge vessel. In addition, the materials properties of the discharge vessel material, which under certain circumstances may be less favorable in terms of the barrier properties, also play a role. Consequently, lamps with outer electrodes generally also require higher operating voltages than lamps with inner electrodes and therefore also require ballasts which are designed for higher voltages and are consequently more expensive. Moreover, the voltage-carrying outer electrodes have to be covered with an electrical insulation for safety reasons. However, inner electrodes require gastight current leadthroughs. This requires additional production steps.

Lamps of the generic type are used in particular in office automation (OA) appliances, e.g. color copiers and scanners, for signal illumination, e.g. as brake lights and indicators in automobiles, for auxiliary lighting, e.g. internal illumination in automobiles, and for background illumination of displays, e.g. liquid crystal displays.

These technical application areas require both particularly short start-up phases and also light fluxes which are as far as possible temperature-independent. Consequently, these lamps do not usually contain any mercury. Rather, these lamps are typically filled with noble gas, preferably xenon, or noble-gas mixtures. While the lamp is operating, in particular excimers, for example $Xe_2^*$ , which emit a molecular band radiation with a maximum at approx. 172 nm, are formed inside the discharge vessel. Depending on the particular application, this VUV radiation is converted into visible light by means of phosphors. These lamps are preferably operated using the particularly efficient pulsed operating mode described in U.S. Pat. No. 5,604,410.

BACKGROUND ART

U.S. Pat. No. 6,097,155 has disclosed a tubular barrier discharge lamp with at least one inner electrode in strip form. One end of the tubular discharge vessel of the lamp is closed off in a gastight manner by a stopper which is fused to part of the inner wall of the discharge vessel by means of soldering glass. The strip-like inner electrode runs to the outside as a supply conductor, through the soldering glass. One drawback is that an additional soldering glass layer, as a gastight joining means, is required between stopper and vessel wall. Moreover, it is necessary to maintain tight tolerances in order to minimize scrap caused by leaks at the stopper seal.

US-A 2002/0163306 has disclosed a tubular barrier discharge lamp with inner electrodes in strip form. At the end of the electrode leadthroughs, the discharge tube is closed off in a gastight manner with the aid of a disk-like closure element which does not use any connecting means. For this purpose, at this end the discharge tube is provided with a constriction which surrounds the edge of the disk-like closure element in the form of a ring. Then, the constriction and the disk-like closure element are fused together in a gastight manner, with the inner electrodes leading out through this fused joint. A drawback of this arrangement is the relatively high production costs.

DISCLOSURE OF THE INVENTION

The object of the invention is to avoid the above-mentioned drawbacks and to provide a dielectric barrier discharge lamp with a simplified closure technique.

This object is achieved by a dielectric barrier discharge lamp having a discharge vessel which is filled with a discharge medium, at least one inner electrode which is arranged on the inner side of the discharge vessel, a dielectric layer on at least one inner electrode, which layer separates the inner electrode or the inner electrodes from the discharge medium, at least one supply conductor, which is electrically conductively connected to the at least one inner electrode in a leadthrough region, which leadthrough region is realized by a gastight pinch.

Particularly advantageous configurations are given in the dependent claims.

Advantages of this solution are the simple and therefore inexpensive production and the fact that the supply conductors are fixedly and integrally connected to the lamp. This makes it possible to dispense with an additional production step for electrically connecting inner electrode and supply conductor, for example by means of soldering, which would otherwise be required. Rather, sufficient and reliable electrical contact between inner electrode and supply conductor is produced by the pinch alone. To make it easier to bring the inner electrode and supply conductor into contact, it is advantageous for a widening of the otherwise thin electrode track to be provided at that end of the inner electrode which is intended for contact, for example by a wide soldering dot being applied to said end.

Moreover, it is advantageous for the pinch to be designed in such a manner that it completely surrounds the connection between the at least one inner electrode and the associated supply conductor. This effectively protects the connection from external environmental influences, such as oxidation, moisture, etc.

In this context, it has been found that the pinch has no adverse effects on the dielectric barrier discharge even in the especially critical region adjoining the pinch. As far as it is currently possible to ascertain, a crucial factor is that the dielectric layer should extend at least as far as the start of the pinch, and preferably partway into the pinch. Otherwise, there is a risk of an undesired high-current discharge structure being formed in said boundary region, with the radiation or light being generated significantly less efficiently compared with the operating method disclosed in U.S. Pat. No. 5,604,410. Moreover, it should be ensured that the discharge vessel is deformed as little as possible in the boundary region by the pinch, and in particular that the electrode spacing should not be altered there. In the case of a tubular discharge vessel with two inner electrodes which are in strip form and are oriented parallel to the longitudinal axis of the discharge vessel and arranged diametrically, this means that the pinch plane should deliberately be placed in the common plane of the two inner electrodes. As a result, the distance between the two inner electrodes remains substantially unaffected by the pinch.

In a preferred embodiment, the at least one inner electrode is realized as a conductor track arranged on the inner side of the wall of the discharge vessel. The at least one supply conductor is preferably realized by an electrically conductive wire, for example made from an iron-nickel alloy. In this context, it has proven advantageous for the wire diameter to be in the range between 0.3 mm and 1.5 mm, preferably in the range between 0.5 mm and 1.0 mm. With wires of larger diameters, there is an increased risk of leaks, and with wires with a smaller diameter the mechanical robustness decreases and therefore so does the practical viability of such wires.

Moreover, for production of the lamp it may be advantageous for an exhaust tube additionally to be provided inside the pinch region. In this case, a suitable tool is used to pinch the discharge vessel in the region of the exhaust tube, in such a manner that the exhaust tube is then embedded in a gastight manner in the pinch but the discharge vessel can still be evacuated, purged if necessary and finally filled with the discharge medium via the exhaust tube. Then, the exhaust tube is melted shut and the lamp is capped if required. In any event, it is possible for the free ends of the supply conductors to make contact with any desired electrical power supply during assembly, for example by soldering, welding or clamping.

BRIEF DESCRIPTION OF THE DRAWINGS

The invention is to be explained in more detail below with reference to an exemplary embodiment. In the drawing.

BEST MODE FOR CARRYING OUT THE INVENTION

The production and technical features of the dielectric barrier discharge lamp according to the invention are illustrated in the figures described below.

Figure 1:
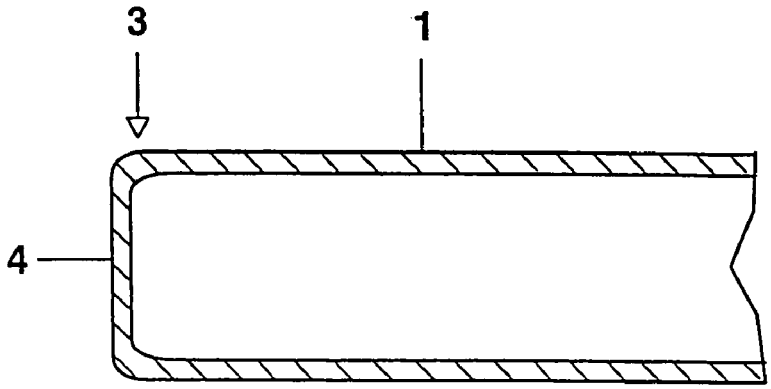
FIG. 1 shows a partial view of a discharge tube which is closed on one side.

FIG. 1 shows part of a discharge tube 1 with an external diameter of approx. 10 mm made from soda-lime glass (e.g. glass No. 360 produced by Philips and/or AR-Glass produced by Schott), which is initially still open at a first end 2 but has already been closed at the other end 3 by means of a fused butt joint 4.

Figure 2A:
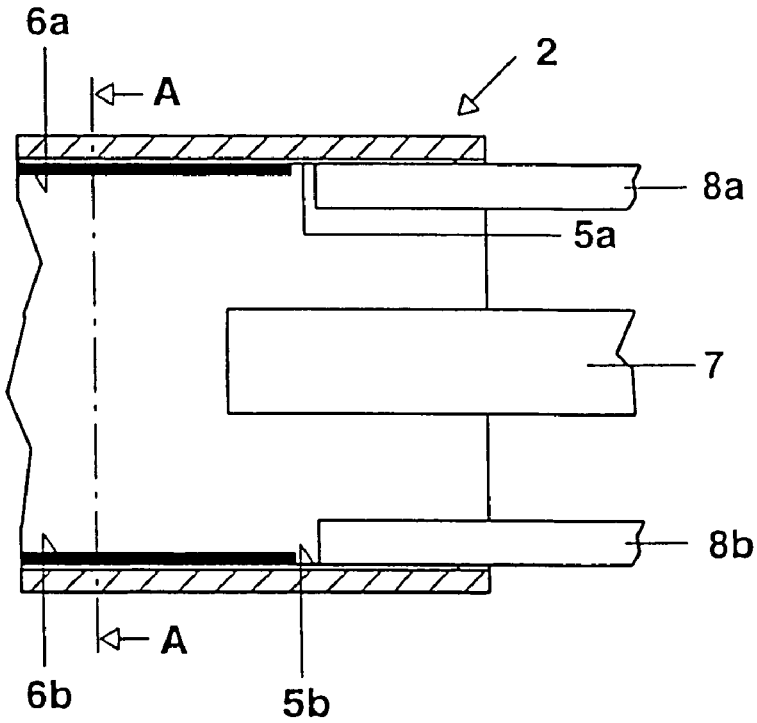
FIG. 2*a* shows a longitudinal section through the unclosed end of the discharge tube shown in FIG. 1 with an inserted exhaust tube and fitted supply conductors.
Figure 2B:
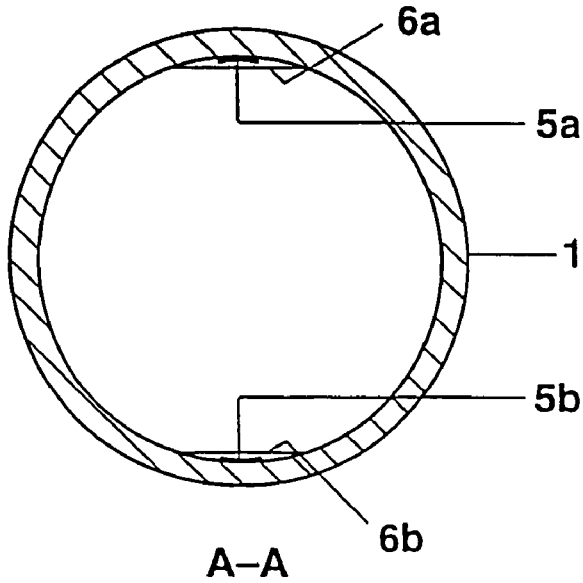
FIG. 2*b* shows a cross section through the discharge tube shown in FIG. 2*a* on line AA.
Figure 2C:
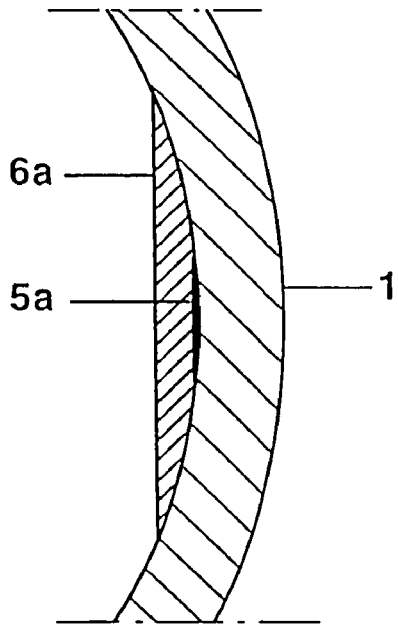
FIG. 2*c* shows a zoomed-in illustration of an inner electrode with a dielectric barrier of the discharge tube shown in FIG. 1.

FIGS. 2*a*, 2*b* show the still open end 2 of the discharge tube 1 in the form of a diagrammatic partial longitudinal sectional view and a cross-sectional view on line AA respectively. The inner wall of the discharge vessel 1 has already been provided with two diametrically arranged inner electrodes 5*a*, 5*b* which are formed as linear conductor tracks and are made from silver with a thickness of approx. 10 μm and a width of approx. 1 mm, covered with a dielectric barrier 6*a*, 6*b* made from soldering glass, thickness approx. 200 μm, width approx. 3.5 mm. FIG. 2*c* shows one of the inner electrodes 5*a* including dielectric barrier 6*a* in the form of a zoomed-in illustration. An exhaust tube 7 is arranged centrally, and initially still loosely, in the open end 2 of the discharge tube 1. Moreover, two supply conductors 8*a*, 8*b* made from iron-nickel wire with a thickness of 0.8 mm project into the still open end 2 in such a manner that they each bear against an associated inner electrode 5*a*, 5*b* and overlap the latter by approx. l=5 mm. To make it easier to bring inner electrode 5*a*, 5*b* and associated supply conductor 8*a*, 8*b* into contact with one another, the end of the inner electrode is widened with the aid of a square soldering dot applied there in a size of approx. 4 mm by 4 mm.

Figure 3:
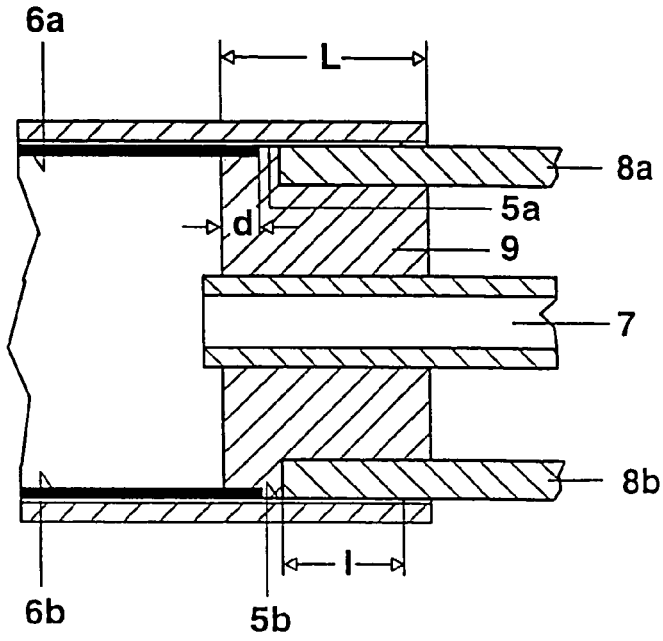
FIG. 3 shows a longitudinal section through that end of the discharge tube shown in FIG. 1 which has been closed off by means of a pinch.

FIG. 3 is similar to FIG. 2*a*. Here, however, the previously open end 2 of the discharge tube 1 has now been closed off by a pinch 9. The pinch 9 lies in the longitudinal section plane which includes the two inner electrodes 5*a*, 5*b* and consequently also the supply conductors 8*a*, 8*b* which have been fitted to them (cf. also FIG. 4*a*, 4*b*). This deliberate orientation of the pinch plane means that the distance between the two inner electrodes 5*a*, 5*b* remains virtually constant all the way to the start of the pinch 9. In the direction of the lamp longitudinal axis, the pinch 9 extends over a length of approx. L=10 mm and in so doing covers both the overlap between the inner electrodes 5*a*, 5*b* and the supply conductors 8*a*, 8*b* and also part of the length d of the dielectric barriers 6*a*, 6*b*. In this way, a reliable and mechanically robust contact between the inner electrodes 5*a*, 5*b* and the supply conductors 8*a*, 8*b* is produced by means of the pinch 9, and this contact is also protected from external environmental influences. For this purpose, holding tongs or a U clip is used before and during the pinching operation to ensure that the supply conductors 8*a*, 8*b* bear against the inner electrodes 5*a*, 5*b* with a gentle pressure. The exhaust tube 7 is arranged in such a way that it projects through the region of the pinch 9 partway into the interior of the discharge tube 1. In this context, the crucial factor is for the exhaust tube 7 still initially to remain fully open after the pinching operation. This ensures that the pinched lamp can still be evacuated, if necessary purged one or more times and finally filled with xenon as discharge medium to an end pressure of approx. 15 kPa via the exhaust tube 7. Only then is the exhaust tube 7 fused shut at its free end.

Figure 4A:
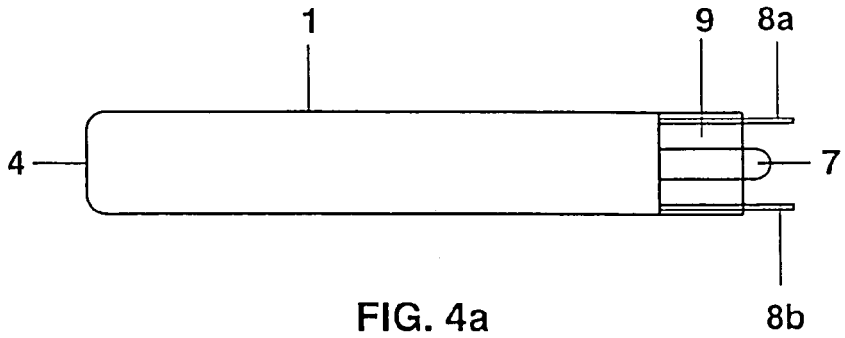
FIG. 4*a* shows a side view of the finished barrier discharge lamp.
Figure 4B:
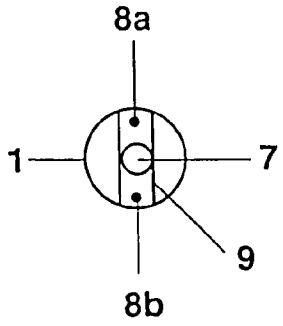
FIG. 4*b* shows an end view of the finished barrier discharge lamp.

FIGS. 4*a*, 4*b* show the finished barrier discharge lamp with the exhaust tube 7 fused shut in the form of highly diagrammatic side and end views, respectively.

Depending on the particular application area, for example for use as an aperture lamp in OA appliances, it is optionally possible for the wall of the discharge vessel to be at least partially provided with phosphor.

What is claimed is:

1. A dielectric barrier discharge lamp, comprising:

a tubular discharge vessel which is filled with a discharge medium;

two inner electrodes having a constant distance between them arranged diametrically on the inner side of the discharge vessel and oriented parallel to the longitudinal axis of the discharge vessel;

a dielectric layer on at least one of the inner electrodes, which layer separates the inner electrode or inner electrodes from the discharge medium;

a leadthrough region comprising a gastight pinch in which the plane of the pinch lies in the common plane of the two inner electrodes, the inner electrodes having ends that extend into the leadthrough region, the constant distance between the electrodes being maintained in the leadthrough region, the dielectric layer at least extending to the pinch;

two supply conductors, each supply conductor associated with one of the inner electrodes, the conductors overlapping and bearing against the end of the associated inner electrode in the leadthrough region to form an electrical connection; and the pinch completely surrounding the electrical connections and maintaining mechanical contact between the inner electrodes and the associated supply conductors.

2. The dielectric barrier discharge lamp as claimed in claim 1, in which the pinch additionally includes an exhaust tube.

3. The dielectric barrier discharge lamp as claimed in claim 1, in which the ends of the inner electrodes that extend into the leadthrough region are widened.

4. The dielectric barrier discharge lamp as claimed in claim 3, in which the ends of the inner electrodes that extend into the leadthrough region are widened with a soldering dot.

5. The dielectric barrier discharge lamp as claimed in claim 1, in which the dielectric layer extends partway into the pinch.

6. The dielectric barrier discharge lamp as claimed in claim 1, in which the supply conductors are wires having a diameter between 0.3 mm and 1.5 mm.

7. The dielectric barrier discharge lamp as claimed in claim 1, in which the supply conductors are wires having a diameter between 0.5 mm and 1.0 mm.

* * * * *